United States Patent [19]

Stretten

[11] 4,070,891

[45] Jan. 31, 1978

[54] COIL-END PEALER AND DEBENDER

[76] Inventor: Ivan J. Stretten, 2829 Lakewood Drive, Drayton Plains, Mich. 48020

[21] Appl. No.: 746,316

[22] Filed: Dec. 1, 1976

[51] Int. Cl.[2] ..... B21C 47/16

[52] U.S. Cl. ..... 72/183; 242/78.8

[58] Field of Search ..... 72/183, 161, 130, 250; 242/78.8, 78.7

[56] References Cited

U.S. PATENT DOCUMENTS

| | | | |
|---|---|---|---|
| 2,887,147 | 5/1959 | Ficht | 242/78.8 X |
| 3,422,653 | 1/1969 | Wiig | 72/161 |
| 3,461,703 | 8/1969 | Ranney | 72/183 |

*Primary Examiner*—Milton S. Mehr

*Attorney, Agent, or Firm*—Dale Austin Winnie

[57] ABSTRACT

Apparatus for pealing the leading end from sheet steel stock material which is rolled in a coil for easier handling in automated stamping equipment, and for guiding it and the subsequent trailing end of the coil immediately into debending and straightening apparatus which is closely next adjacent thereto. The debender includes fixed and movable dies that are complimentary, are mounted in-line with and immediately between the coil-end pealer and the stock feeding pinch rolls, with the movable die mounted on a channel beam section which also carries the piston cylinders operative thereof. The pealer, debender and pinch rolls all being mounted on and between common side wall supports in sufficiently closely spaced proximity to each other for the greatest proficiency and stock handling ease.

5 Claims, 4 Drawing Figures

COIL-END PEALER AND DEBENDER

BACKGROUND OF THE INVENTION

It is generally known to use rolls of coiled steel of a desired width and selected gauge in automated stamping operations.

The large diameter rolls are normally placed in a coil handling line which includes a cradle with adjustable inner side walls to accommodate different width rolls, nest rolls that the coil rests on and turns on as it is unwound, and a peeler or like means to catch and start the leading edge of the sheet steel on its course to the stamping machine. Pinch rolls or like means are used to draw off, measure and feed the stock material to the stamping equipment and the line normally includes an extended stock guiding means or way whereby there is a reasonable stock of material that is looped away and back again for more free stock flow to the presses.

Although coils of considerable size can be handled by such equipment, the material is relatively quickly used in the stamping operation and close attention is due to renewing the rolls of coiled steel that are being used.

Also, close attention is due in both starting a coil and in the final stage of its run due to the tighter turn that is normally provided at the leading and trailing edges of such coils.

Some stamping lines use a power straightener between the coil handling line and the presses to straighten the stock at the leading end of the coil and again at its trailing end. Other operations find it more expedient to simply cut off a length of stock at the beginning and end of each roll, rather than to try to straighten it out.

What is needed is a means to remove the troublesome excessive curvature in the stock material right at the roll, as it is first being taken from the cradle, so that it is more straight and acceptable in the pinch rolls and through the other stock handling parts of the line, and to again straighten out the tail end of the stock, rather than cut if off and lose it, so that it will not be curled up and catch or hang-up as it runs out.

SUMMARY OF THE INVENTION

This invention relates to a pealer and coil end debender mechanism in combination and which are port of a coil handling line designed and engineered to receive and remove large curvatures at both the leading and trailing ends of a coil of heavy gauge coiled steel right as they come off the coils.

The pealer includes lateral and forwardly adjustable fingers that are capable of catching and directing first the leading end and then the side edges of the coiled material right into the debender for straightening and subsequently guiding the coiled material through it and keepin the trailin end from flipping up, as it is otherwise prone to do, and causing damage or difficulty in getting it into the debender.

The coil end debender is provided immediately next adjacent the pealer and includes two large diameter cylinders which are air operated and arranged so that when a coil of steel is loaded in a receptive coil cradle, the leading edge of the stock is positioned to be automatically peeled from the coil as its bands are cut and directed into or towards the debender. Then as the coil is being run out the trailing edge of the coil is also guided to pass through the debender and kept from flipping up so that the excessive curvature at the end of the stock roll can be removed and will not hang-up in its final pass through the guide ways to the stamping equipment.

The coil end debender includes a heavy duty air operated press that is mounted with the peeler and feed rolls between common side walls immediately next to the cradle that carrys the coil of stock material and between it and the guide ways that direct the material to the stamping equipment that uses it.

Of further note is that the large diameter air operated cylinders which power the debender, are mounted on with and over the forming die to add their weight and effect with the latter as it reforms and straightens the coil end on the fixed platen over which the stock end passes.

These and other objects and advantages to be gained in the use of the particular arrangement shown and hereinafter described in further detail will be more apparent upon a reading of the following specification.

DESCRIPTION OF THE DRAWING FIGURES

DETAILED DESCRIPTION OF THE ILLUSTRATED EMBODIMENT

Figure 1:
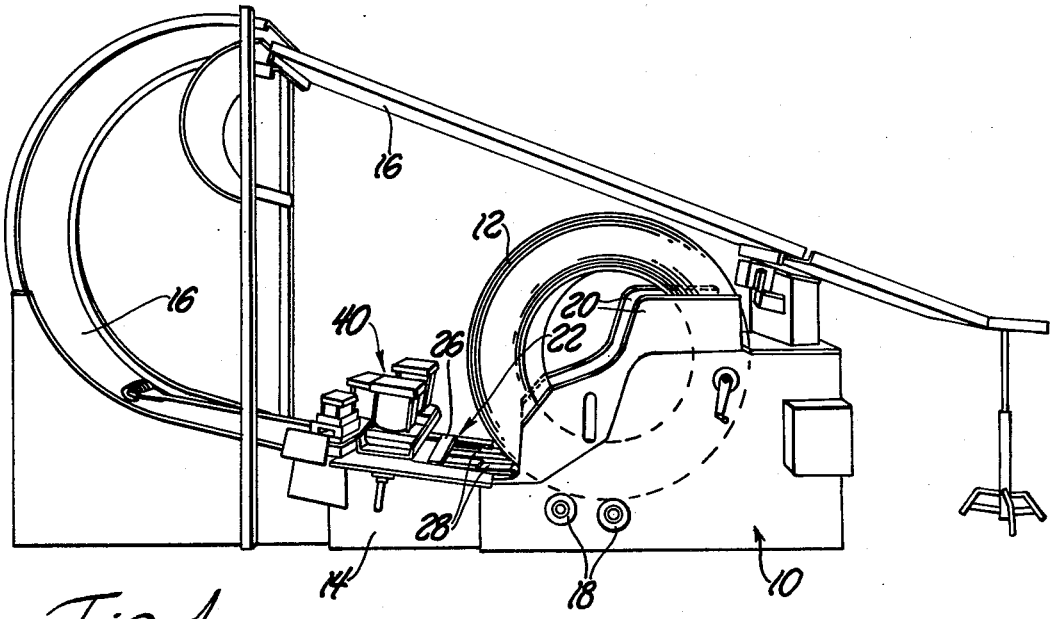
FIG. 1 is a perspective view of a coil handling line, for heavy duty coil-rolled stock material, and having the present invention shown in use therewith.

The equipment shown in the first drawing figure is for handling a coil of heavy gauge steel.

It includes an arrangement which provides a cradle stand 10 to receive and hold the coil, identified as 12, an intermediate stand part 14 with the improvements of the present invention provided thereon, and a deflecter and chute part 16 to receive and direct the stock material coming off the coil in an over-head loop back over the cradle stand and to the stamping equipment (not shown) where it will be used.

The cradle stand 10 includes spaced rolls, such as 18, on which the large coil of heavy gauge steel sets, and a pair of side plates 20 which are laterally adjustable for the relative width of the stock material being used.

A peeler 22 is mounted on the intermediate stand 14 to extend into the cradle stand 10 and includes one or more members 24 which are laterally adjustable on a cross bar 26 to accommodate different width materials and which have forward and rearwardly adjustable finger-like extensions 28 that are capable of being set to catch and peel off the first turn of a coil sufficiently in from its side edges to prevent any intermediate bow and to otherwise serve in guiding it into the debender which follows.

Following the debender is a set of pinch rolls 30, 32 between which the stock material must pass and which serve to draw stock material from the coil and feed it on its way to the stamping machine. One of these rolls is relatively fixed in location on the end of the stand and the other is capable of being moved relatively towards and separated from the first roll under the operational control of a pair of air operated cylinders 34, 36.

Between the peeler 26 and the pinch rolls 30, 32 is provided the debender 40 of the present invention.

The location of the debender 40 is significant in that it follows immediately after the peeler and therefor is the first to receive the leading end of the stock material, as it is taken off the coil. And, it is this leading end of the stock material which is turned in on the coil, and consequently turned up on the stock material, as it is taken off the coil, that has heretofore always caused concern and problems and usually has had to be cut off and lost as scrap to prevent hanging up the stock material in its normal course of being fed to the stamping equipment that uses it.

Similarly, just as the debender is the first to receive and be capable of taking corrective action on the leading end of the coil material, it is also so disposed with respect to the trailing end of the coil material, which will be appreciated as in an even tighter turn than the rest of the stock material and to consequently also require attention in order to prevent it from being hung up in some way in the course of stock flow to the work-use source.

Figure 4:
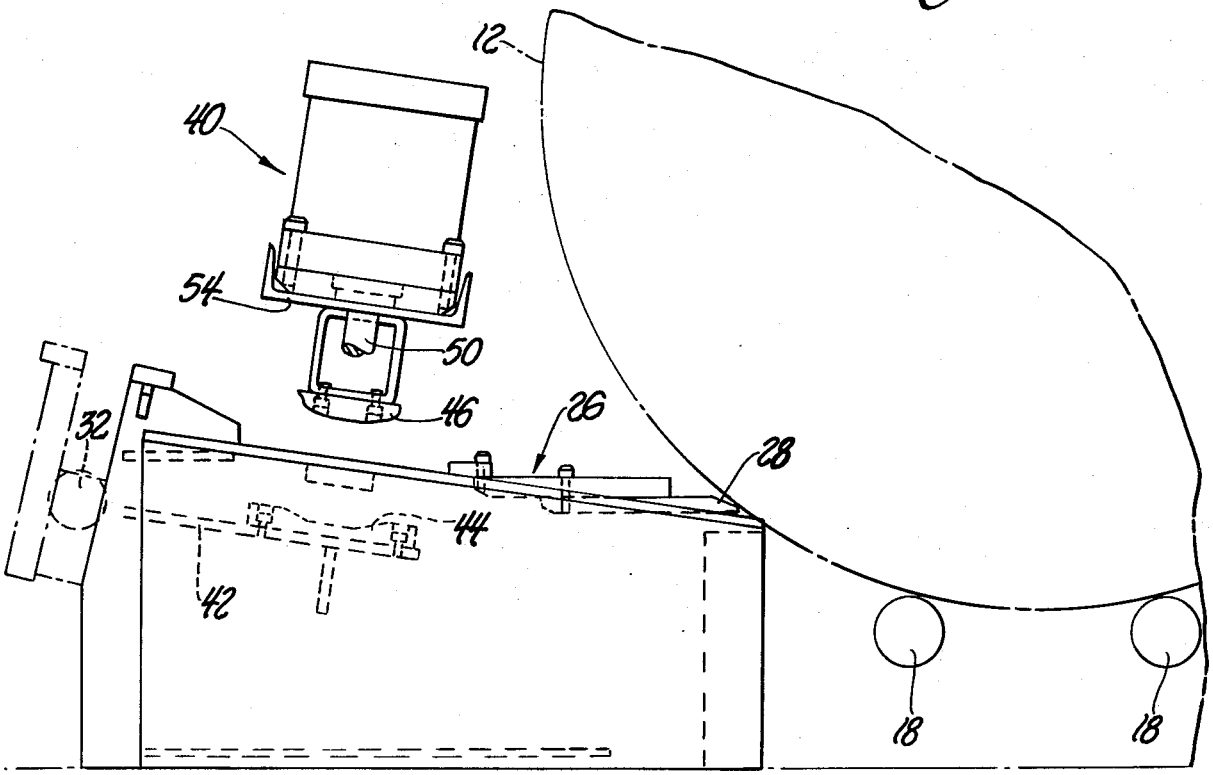
FIG. 4 is a side plan view of the equipment shown in the previous drawing figures with only such parts illustrated as best help explain and understand the present invention.

Referring now specifically to the debender 40:

Between the side walls of the cradle stand, and relatively just under, or below, the level of the peeler and lower pinch roll, is provided the reinforcing plate 42 on which is mounted the lower forming die 44; as shown in FIG. 4. Although difficult to see in the drawing figures, it will be appreciated that the lower and relatively fixed forming die extends between the side walls of the cradle stand as necessary to accommodate the various widths of coil stock which are capable of being handled in the cradle stand itself.

Immediately over the lower forming die 44 is provided the movable die 46 of the debender mounted on an operating mechanism supported on the two side walls of the cradle stand.

Figure 2:
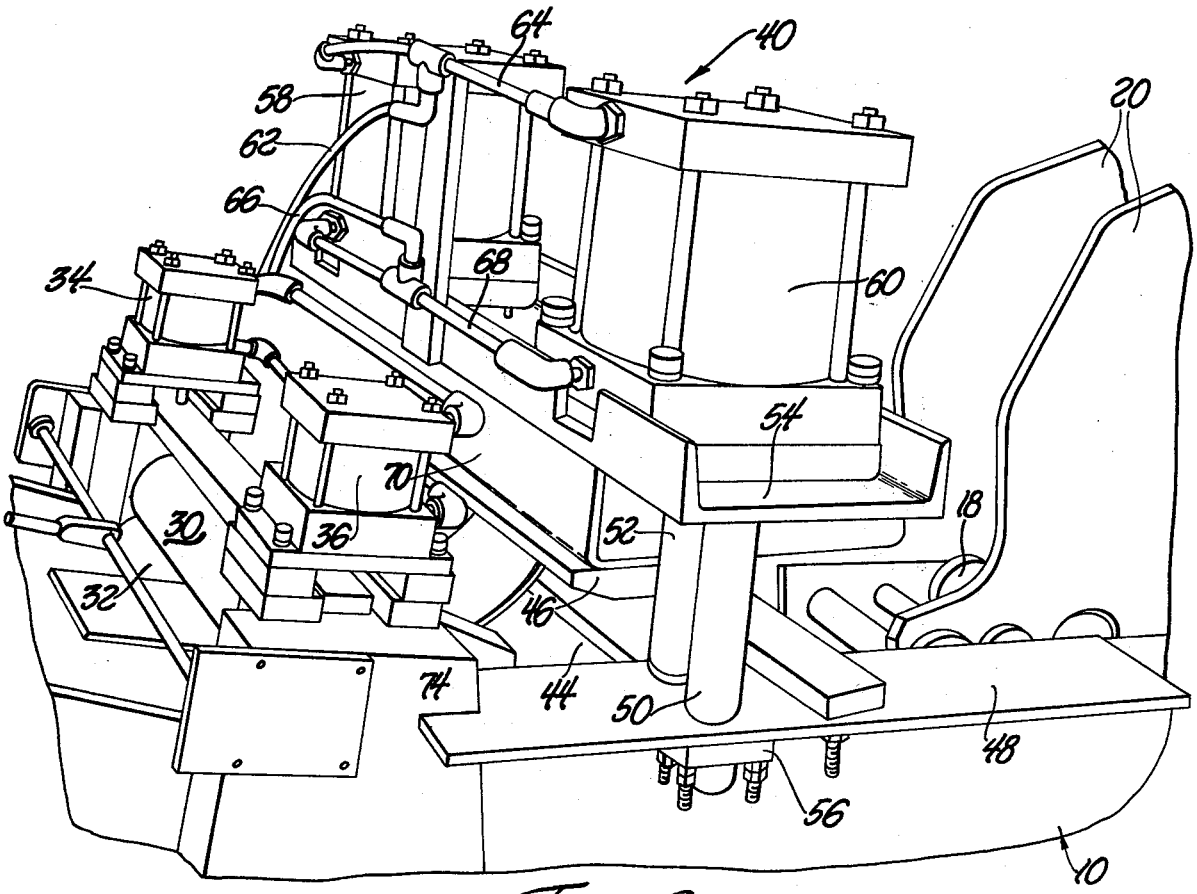
FIG. 2 is an enlarged perspective of the same equipment shown in the first drawing figure with the coil-end debender of the present invention shown open and receptive of a coil-end therewithin.
Figure 3:
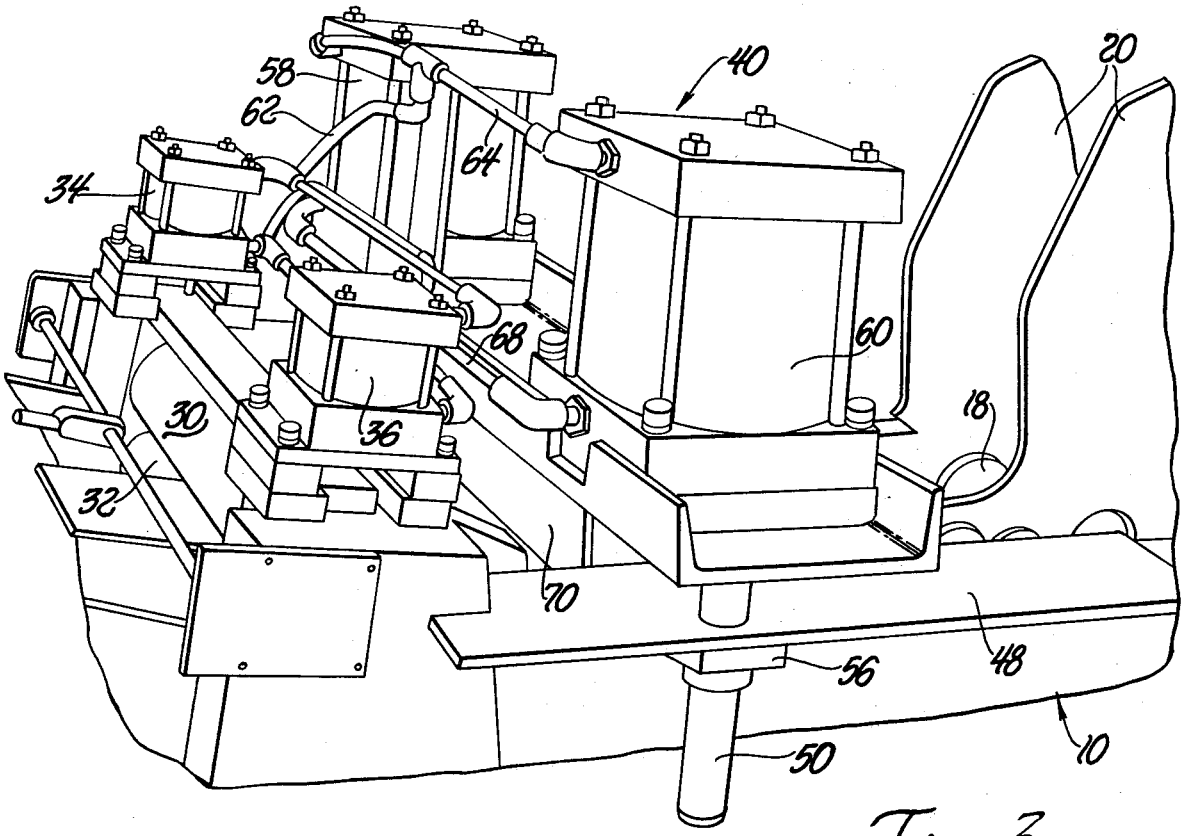
FIG. 3 is similar to FIG. 2 with the coil-end debender shown in use and in the process of straightening the coil-end received therein.

As best shown in FIGS. 2 and 3, outwardly turned flanges 48, provided by plate stock welded to the upper edges of the cradle stand side walls, serve as a mounting stand for a set of guide posts 50, 52 at each side wall. The guide posts 50 have their upper ends fixed to opposite ends of a channel beam 54 and pass through a guide bushing 56 mounted on the underside of the mounting flanges 48. The other guide posts 52 are actually piston rod members which have their lower ends fixed to the mounting flanges 48 and their upper ends received within piston cylinders 58 and 60 carried on the channel beam 54.

The piston cylinders 58 and 60 are air operated and the air line connections 62, 64 to and between the upper ends of the cylinders, and the air line connections 66, 68 to and between their lower ends, serve to cause the cylinders and the channel beam on which they are mounted to be raised and lowered relatively over the lower disposed debender forming die 44.

Mounted on the underside of the channel beam 54, between the guide posts 50, 52, is a box sectioned structural reinforcing beam member 70 and on its underside is mounted the complimentary forming die 46 which mates with and the matches the lower disposed forming die 44.

As will be appreciated, the size of the air operated piston cylinders is as necessary to provide te re-forming force and pressure to reshape and straighten out the leading and/or trailing ends of the heavy gauge stock material as it is positioned and momentarily stopped between the two dies 44, 46.

In the first drawing figure the leading end 72 of a run of stock from the coil 12 is shown as passing relatively under the overhead pass and through the guideway 16 back towards where it will be used.

FIGS. 2 and 3, on the other hand, show a set-up condition in which the stock has been run off the coil and the trailing end is just passing through the forming dies 44, 46 of the debender. In FIG. 2 the up-turned trailing end 74 is shown with the dies separated. However, in FIG. 3 it is not visible since this is the condition with the dies closed upon it.

In use, the debender is normally set with the forming dies 44, 46 separated. After a new coil is set in the cradle stand 10 it is turned to have the pealer 26 catch and direct the leading end of the coil thereunder and consequently between the forming dies of the debender. The debender is operated to straighten the leading end of the coil and the coil is then turned again in the cradle as necessary to have the reformed leading end of the stock material pass between the pinch rolls, which are separated to receive it.

At the end of the coil run, just as the trailing end of the stock is about to pass through the debender, the pinch rolls are stopped, the debender is operated again and the stock is then run out without further need for concern.

I claim:

1. A stock roll coil-end debender for use in line and combination with coil-end pealing means, and comprising;

parallel spaced side wall members providing common wall support for and having mounted therebetween said coil-end pealing means, at one end, stock roll feeding means, at the other end, and said coil-end debender therebetween, said debender including a fixedly located forming die mounted between said common side wall support members and having an upwardly open concavity, a complimentary forming die provided relatively over said fixedly located forming die for use therewith and having means providing power operated reciprocation thereof mounted on each of said side wall members, and said forming dies being relatively disposed and spaced as separated to receive a coil end from a stock roll therebetween, being relatively formed for use in straightening said coil end, and being sufficiently close to said stock roll feeding means for subsequent ease in having stock material and coil ends thereof fed thereto and through.

2. The stock roll coil-end debender of claim 1, the reciprocation means including piston cylinder members operative of and reciprocal with said complimentary forming die.

3. The stock roll coil-end debender of claim 2, said piston cylinder members being provided on a common channel beam section extending between said side walls and having said complimentary forming die mounted thereon and extending therebelow.

4. The stock roll coil-end debender of claim 3, including; guideways and means provided on and between the ends of said channel beam section and said side walls and said piston cylinder members having the piston rod ends extending therefrom attached to said side walls for effecting the reciprocal actuation called for.

5. The stock roll coil-end debender of claim 4, including;

a cross bar mounted on said side wall support members and to extend therebetween next adjacent said debender and relatively between said debender and the coil supporting cradle means, members mounted on said cross bar which are laterally adjustable and are disposed to extend relatively towards said coil supporting cradle, and finger-like members forwardly and rearwardly adjustable on said last mentioned members for being positioned in closer proximity to the leading end of a coil of stock material in roll form disposed on said cradle means, said laterally forwardly and rearwardly adjustable members being capable of being relatively set inwardly from the side edges of the stock material being uncoiled for more proficient guiding engagement therewith than at the outer edges thereof and for precluding undesirable bowing of the stock material therebetween.

* * * * *